US005205981A

United States Patent [19]

Fujikawa et al.

[11] Patent Number: 5,205,981

[45] Date of Patent: Apr. 27, 1993

[54] METHOD AND APPARATUS FOR THE PRODUCTION OF SEMI-SOLIDIFIED METAL COMPOSITION

[75] Inventors: Yasuo Fujikawa; Yuji Yoshikawa; Katsuhiro Takebayashi, all of Chiba, Japan

[73] Assignee: Rheo-Technology, Ltd., Japan

[21] Appl. No.: 865,999

[22] Filed: Apr. 9, 1992

Related U.S. Application Data

[62] Division of Ser. No. 703,901, May 22, 1991.

[30] Foreign Application Priority Data

Dec. 28, 1990 [JP] Japan ..... 2-418097
Apr. 2, 1991 [JP] Japan ..... 3-94990

[51] Int. Cl.[5] ..... C22C 23/00
[52] U.S. Cl. ..... 266/234; 420/590
[58] Field of Search ..... 266/234; 420/590

[56] References Cited

U.S. PATENT DOCUMENTS 3,954,455 5/1976 Flemings ..... 420/590

FOREIGN PATENT DOCUMENTS 1138044 5/1989 Japan .
1138045 5/1989 Japan .

*Primary Examiner*—Peter D. Rosenberg
*Attorney, Agent, or Firm*—Austin R. Miller

[57] ABSTRACT

In a method and an apparatus for producing a solid-liquid metal mixture in which non-dendritic primary solid particles are dispersed into the remaining liquid matrix through electromagnetic induction system, a core member is arranged inside a cooling agitation tank provided with an electromagnetic induction coil therearound.

10 Claims, 6 Drawing Sheets

METHOD AND APPARATUS FOR THE PRODUCTION OF SEMI-SOLIDIFIED METAL COMPOSITION

This application is a divisional of application Ser. No. 07/703,901, filed May 22, 1991.

BACKGROUND OF THE INVENTION

1. Field of the Invention

This invention relates to a method for producing a solid-liquid metal mixture in which non-dendritic primary solid particles are dispersed into the remaining liquid matrix (hereinafter referred to as a semi-solidified metal composition) through an electromagnetic induction agitating system and an apparatus used therefor.

2. Related Art Statement

As a method for the production of the semi-solidified metal composition, there are roughly known a mechanical agitating method and an electromagnetic induction agitating method. The electromagnetic induction agitating method (hereinafter referred to as an electromagnetic agitation simply) is poor in agitating efficiency as compared with the mechanical agitating method but is less restricted in the materials used in the apparatus and high in productivity. As a result, there have hitherto been proposed many improvements for the electromagnetic agitation.

In Japanese Patent Application Publication No. 61-7148 and No. 62-25464, there are disclosed a method of continuously or semicontinuously producing a metal slurry at a semi-solidified state through an electromagnetic agitation system and an apparatus used therefor.

In such a method, an electromagnetic agitation means producing a rotating magnetic field through a bipolar electric motor stator or the like is used and a mold provided with a cooling means is arranged inside thereof. Then molten metal is charged into the mold from above and cooled and agitated therein while being rotatably moved through the rotating magnetic field, whereby there is obtained a metal slurry of a semi-solidified state in which non-dendritic primary solid particles formed by breaking of dendrites are dispersed into the remaining liquid matrix.

In order to provide a metal slurry of good semi-solidified state, it is required to have strong cooling for forming sufficiently small solid particles and vigorous agitation strength for shearing dendrites. In the electromagnetic agitation system, however, the above two conditions are conflicting, so that it can not necessarily be said to satisfy the above conventional method and apparatus.

That is, there are the following problems in the conventional method and apparatus for the production of semi-solidified metal composition through an electromagnetic agitation system:

(1) In order to produce good semi-solidified metal compositions, it is necessary to give a vigorous agitation effect while cooling molten metal. If it is intended to conduct vigorous agitation through conventional electromagnetic agitation or high-speed rotating movement, a large eddy dent is created in the central portion of the rotating movement of molten metal through centrifugal force, while the level of the outer peripheral portion of molten metal becomes higher, consequently the scattering of molten metal from an upper part of a cooling agitation tank and the gas entrapment increases and stable operation is impossible. Therefore, the high-speed rotating movement or vigorous agitation effect can not be attained in the conventional electromagnetic agitation system.

(2) Although the central portion of molten metal is rotated at a high speed, the agitation effect is less and hence the agitation effect the horizontal section of molten metal becomes nonuniform. On the other hand, the rotating speed or agitation effect is dependent upon the viscosity of molten metal, so that as the apparent viscosity at the semi-solidified state becomes high, the agitation effect lowers and particularly the mixing effect is lost at the central portion and hence a risk of causing segregation becomes large.

(3) In order to produce the good semi-solidified metal composition, it is necessary to conduct strong cooling for forming sufficiently small solid particles. In the conventional electromagnetic agitation system, the internal volume of the cooling agitation tank is large with respect to the area of the inner wall or cooling wall thereof and the heat capacity of molten metal is large, so that the cooling rate can not be made fairly high due to heat generation of current produced through the rotating magnetic field.

On the other hand, when the strong cooling is carried out by using a water-cooled copper plate in the inner wall, the solidification shell adheres to the inner wall and gradually grows to largely reduce the magnetic flux of the rotating magnetic field, whereby the agitation effect is considerably decreased, so that the cooling strength in the inner wall is critical.

(4) In the conventional electromagnetic agitation system, the central portion of rotating movement of molten metal or the central portion of the cooling agitation tank forms a dead space for the production of the semi-solidified metal composition and is harmful and useless.

SUMMARY OF THE INVENTION

It is, therefore, an object of the invention to effectively solve the above problems of the conventional technique and to provide a method and an apparatus for the production of semi-solidified metal compositions through electromagnetic agitation which can eliminate the scattering of molten metal and the entrapment of gas and increase the agitation and cooling effects and attain the stable operation.

The inventors have considered that it is most effective to remove molten metal from the central portion of rotating movement of molten metal or the central portion of the cooling agitation tank substantially not contributing to the cooling and agitation effects for solving the above problems and made various studies and as a result the invention has been accomplished.

According to a first aspect of the invention, there is the provision of a method of producing semi-solidified metal compositions through electromagnetic agitation system by charging molten metal into a cooling agitation tank and then taking out heat of molten metal with an inner wall of the tank to cool molten metal and at the same time rotatably moving molten metal through a rotating magnetic field horizontally acting across the tank to agitate molten metal, characterized in that said molten metal is rotatably moved between an outer wall face of a non-magnetic and non-conductive core member arranged in a central portion of the tank and an inner wall face of the tank.

According to a second aspect of the invention, there is the provision of an apparatus for producing semi-solidified metal compositions through electromagnetic agitation, comprising a cooling agitation tank provided with a means for cooling molten metal, an electromagnetic induction coil producing a rotating magnetic field across the section of the tank to forcedly conduct rotating movement of molten metal in the tank, and a non-magnetic and non-conductive core member arranged in a central portion of the tank.

In a preferred embodiment of the invention, the core member is repeatedly lifted in up and down directions inside the tank during the rotating movement of molten metal. Furthermore, the core member acts as a stopper for preventing the flow down of molten metal from a discharge port of the tank at the lift down state and controlling the flowing rate of resulting semi-solidified metal composition from the discharge port at the adjusted lift height. Moreover, a cooled body is used as a core member for increasing the cooling efficiency of molten metal.

In another preferred embodiment of the invention, the core member is rotatably supported and fixed through a torque meter. The outer size of the core member is within a range of 30–60% of an inner diameter of the cooling agitation tank. Furthermore, the shape of the inner wall face of the cooling agitation tank is preferable to be cylindrical, and the shape of the outer wall face of the core member is basically cylindrical but may be various forms for the improvement of the agitation effect and the like. Moreover, the core member is preferably positioned in such a manner that the center axis of the core member substantially meets with the center axis of the cooling agitation tank, but the center axis of the core member may be somewhat shifted from the center axis of the tank. When the core member acts as a stopper, the shape of the top portion of the core member is rendered into a proper form such as hemisphere or the like in accordance with the shape of the discharge port in the cooling agitation tank.

In the other preferred embodiment of the invention, when the cooled body is used as a core member, at least two cooled bodies are provided and alternately and repeatedly used in the cooling agitation tank, in which one of the cooled bodies is immersed in molten metal and the remaining cooled body or the used cooled body is cooled or preliminarily heated to a given cooling temperature at a waiting position. The cooled body is comprised of ceramic, cermet, metal or a composite body thereof.

BRIEF DESCRIPTION OF THE DRAWINGS

The invention will be described with reference to the accompanying drawings, wherein.

DESCRIPTION OF THE PREFERRED EMBODIMENTS

When semi-solidified metal compositions are produced from molten metal by cooling and agitating through rotating movement of molten metal in rotating magnetic field according to the invention, the non-magnetic and non-conductive core member made of, for example, a refractory material or ceramics is arranged in the rotating center portion of molten metal or the central portion of the cooling agitation tank, whereby molten metal is removed from the rotating center portion as a dead space.

Thus, molten metal is agitated through rotating movement between the outer wall face of the core member and the inner wall face of the cooling agitation tank. In this case, the rotating speed of such a rotating movement is small as compared with the case of using no core member, but the eddy dent of surface level of molten metal is decreased to a practical extent and hence the stable operation can be attained without scattering molten metal. Furthermore, lowering of the agitation effect can be prevented by properly selecting the size of the core member, though the rotating speed becomes small. Moreover, when the core member is lifted in up and down directions, molten metal is moved in up and down directions in addition to the rotating movement, whereby more homogeneous semi-solidified metal composition can be produced. In the latter case, the core member acts as a stopper at the time of starting the operation.

A first embodiment of the apparatus for the production of semi-solidified metal composition according to the invention will be described with reference to FIG. 1.

Figure 1:
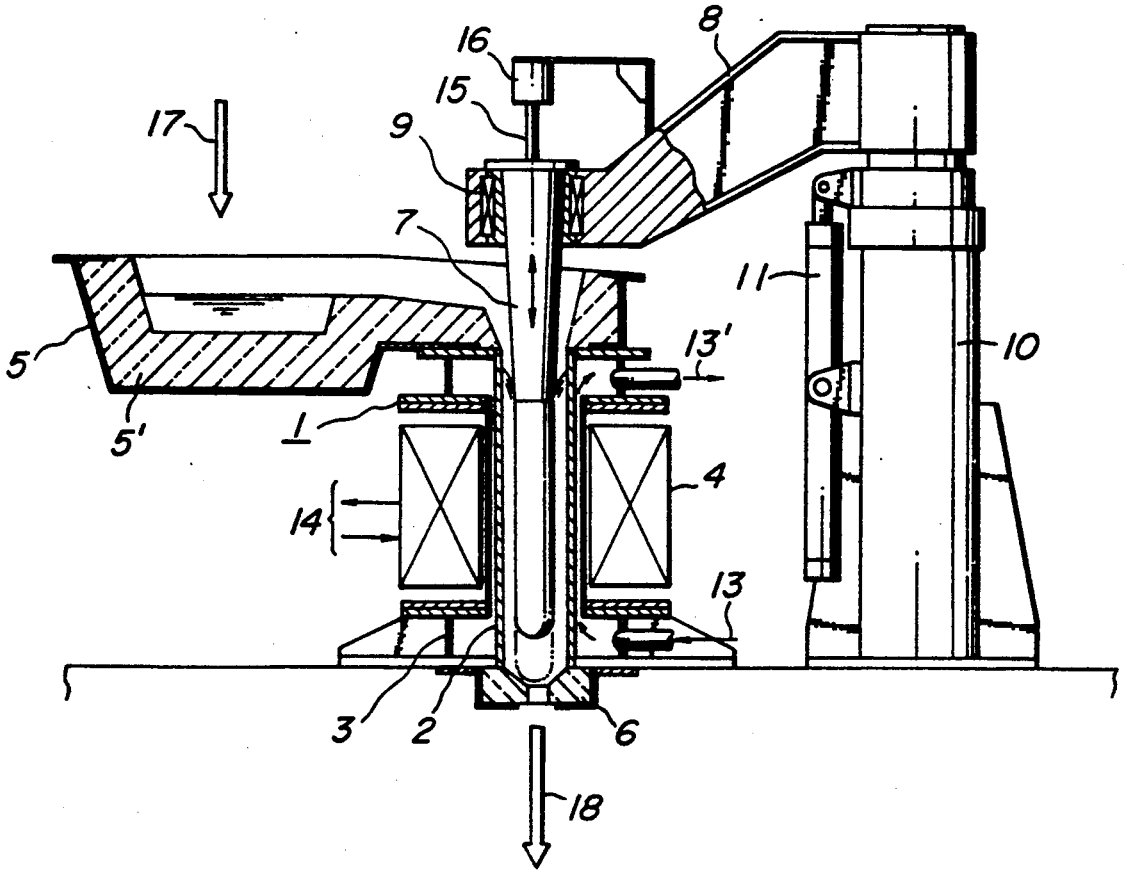
FIG. 1 is an outline of a first embodiment of the apparatus for the production of semi-solidified metal composition according to the invention.

As shown in FIG. 1, a cooling agitation tank 1 is comprised of a vertical cooling cylinder 2 and a water-cooled jacket 3, and an electromagnetic induction coil 4 is arranged around the outer periphery of the tank 1. Each of the cooling cylinder 2 and the water-cooled jacket 3 is made from a thin and non-magnetic metal plate for reducing attenuation of magnetic flux as far as possible. In the cooling agitation tank 1, cooling water is supplied to a lower part 13 of the water-cooled jacket 3 and discharged from an upper part 13′ thereof, during which cooling water passes the outer surface of the cooling cylinder 2 at a high speed to give a proper cooling effect to molten metal existing inside the the cylinder 2. Moreover, the inner wall face of the cylinder 2 may be lined with a refractory material of a proper thickness. As the electromagnetic induction coil 4 is frequently used a stator coil of bipolar, three-phase induction motor, to which is supplied a three-phase alternating current 14 to provide a rotating magnetic field in the center of the coil. As a result, molten metal is agitated in the cooling agitation tank 1 through rotating movement by rotating torque in proportion to the magnetic flux density of the rotating magnetic field.

A tundish 5 for molten metal lined with a refractory material 5′ is arranged on the upper end of the cooling agitation tank 1, while a discharge nozzle 6 is arranged on the bottom portion of the tank 1.

In the central portion of the cooling agitation tank 1 is arranged a non-magnetic and non-conductive core member 7 made from, for example, a refractory material. The core member 7 is rotatably supported by a support arm 8 through a bearing 9 as shown in FIG. 1. Furthermore, the support arm 8 is liftably mounted on a support base 10 through a lifting means 11 such as hydraulic cylinder or the like. Moreover, a torque meter 16 is attached to the core member 7 through a connecting rod 15.

In operation, molten metal 17 is continuously fed into the tundish 5, from which molten metal flows into the cooling agitation tank 1. Then, molten metal is cooled by adequate cooling action of the cooling cylinder 2 in the tank 1 and simultaneously agitated through rotating movement between the outer wall face of the core member 7 and the inner wall face of the cylinder 2 based on a rotating magnetic field generated by the electromagnetic induction coil 4, whereby resulting dentrites are converted into such a state having a spheroidal or granular shape that dendritic branches are substantially eliminated or reduced and at the same time the resulting non-dendritic primary solid particles are dispersed into the remaining liquid matrix to form a semi-solidified metal composition 18. Then, the semi-solidified metal composition 18 is continuously discharged from the discharge nozzle 6 located at the bottom of the cooling agitation tank 1. In this case, the core member 7 may be set to a given position or may be moved in up and down directions in the tank 1 through the lifting means 11 for more promoting the agitating effect. Moreover, the properties and agitating state of the semi-solidified metal composition can be estimated by measuring the viscosity torque of the semi-solidified metal composition acting to the core member by means of the torque meter 16.

After the completion of the operation, the core member 7 is lifted upward from the tank 1 through the support arm 8 by the actuation of the hydraulic cylinder 12. Preferably, the support arm 8 is turned for making easy the maintenance and inspection of the cooling agitation tank 1.

Figure 2:
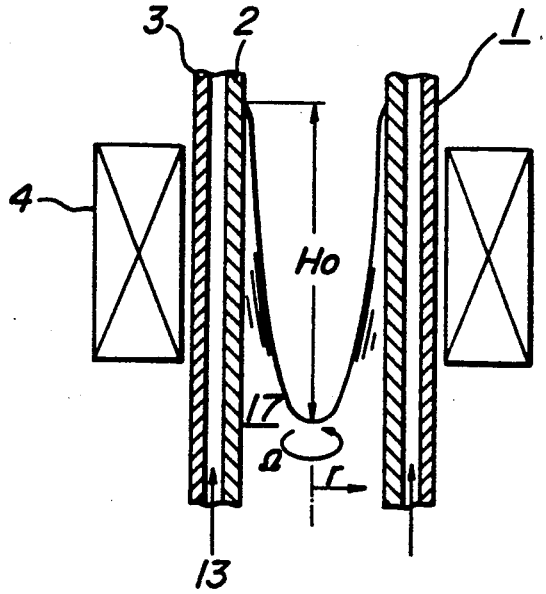
FIG 2 PRIOR ART
FIG. 2 is a theoretical view showing an agitating action in a conventional electromagnetic agitation system.
Figure 3:
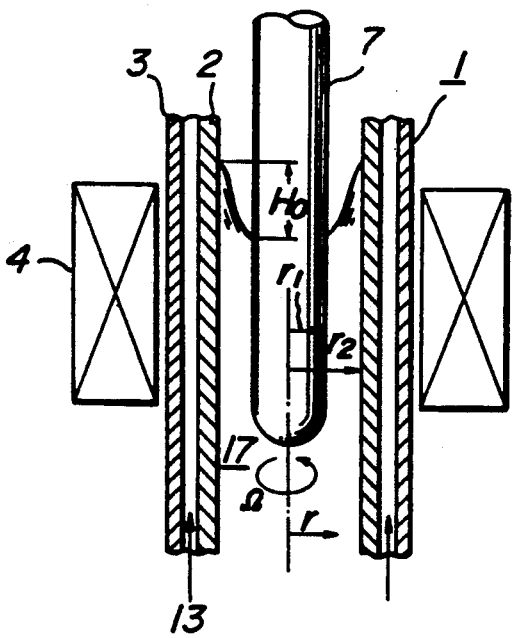
FIG. 3 is a theoretical view showing an agitating action in the electromagnetic agitation system according to the invention.
Figure 4:
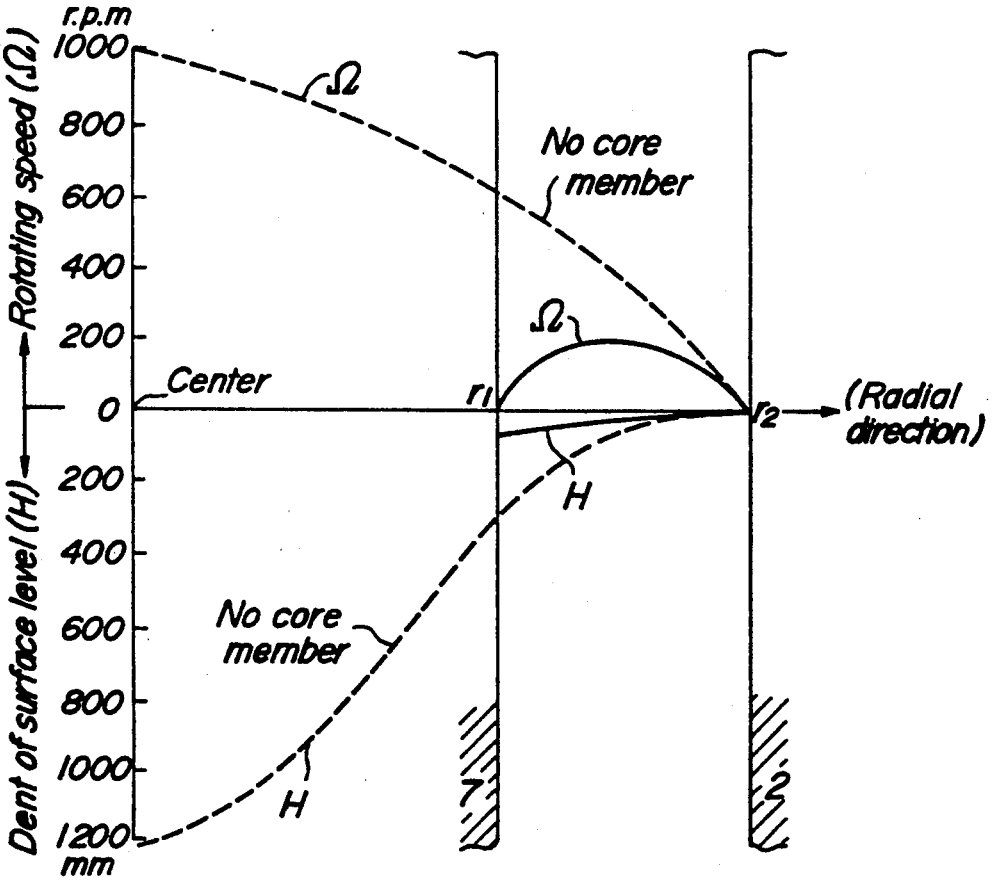
FIG. 4 is a graph showing agitation effects in the electromagnetic agitation system according to the conventional technique and the invention.

Then, the invention will be described with respect to the agitating action. FIG. 2 shows a theory of the agitating action in the conventional electromagnetic agitation system, and FIG. 3 shows a theory of the agitating action in the electromagnetic agitation system according to the invention, and FIG. 4 is a graph representing the above agitating effect as a numerical value. In FIGS. 2 and 3, the cooling agitation tank 1 comprised of the cooling metal cylinder 2 and the water-cooled jacket 3 and the electromagnetic induction coil 4 arranged therearound are common, but the core member 7 is arranged inside the tank 1 in the system of FIG. 3. In the conventional system of FIG. 2, as the agitating through the rotating magnetic field becomes strong, molten metal 17 in the tank 1 is rotated at a high speed, in which the rotating speed ($\Omega$) is at its maximum at the central portion of the tank 1 as shown in FIG. 4, and consequently a large eddy dent ($H_0$) is created at the center by centrifugal force. If the eddy dent ($H_0$) becomes too large, there are caused problems such as scattering of molten metal from the upper part of the tank, entrapment of gas and the like, which is difficult to put into practical use. Although the central portion of molten metal is rotated at a very high speed, shearing force required for the conversion of dendrites is very small or the agitating effect is substantially zero.

As shown in FIG. 3, according to the invention, the cylindrical core member 7 having a radius $r_1$ is arranged in the Central portion of the tank 1. If the rotating magnetic field having the same intensity as in the conventional system is applied to the system according to the invention, the rotating speed ($\Omega$) of the rotating movement produced in molten metal 17 becomes zero at the inner wall face of the cooling cylinder 2 and the outer wall face of the core member 7, so that the maximum rotating speed becomes small. As a result, the eddy dent ($H_0$) produced through centrifugal force becomes fairly small, which solves problems in practical use. Furthermore, the agitating effect generated in horizontal section of molten metal or shearing stress is substantially the same over such a section on average though the rotating speed is smaller than that of the conventional system, so that the agitating effect becomes very effective for molten metal.

In the electromagnetic agitation system, molten metal itself rotates through the rotating force of electromagnetic induction produced in molten metal, so that the rotating speed of molten metal or semi-solidified metal composition or the agitating effect of molten metal itself is dependent upon the viscosity of molten metal or semi-solidified metal composition. Although it is difficult to confirm the rotating speed or the agitating effect in the conventional system, according to the invention, the agitating effect is estimated by measuring the viscosity torque of molten metal by means of the torque meter 16 directly connected to the core member 7.

Figure 5A:
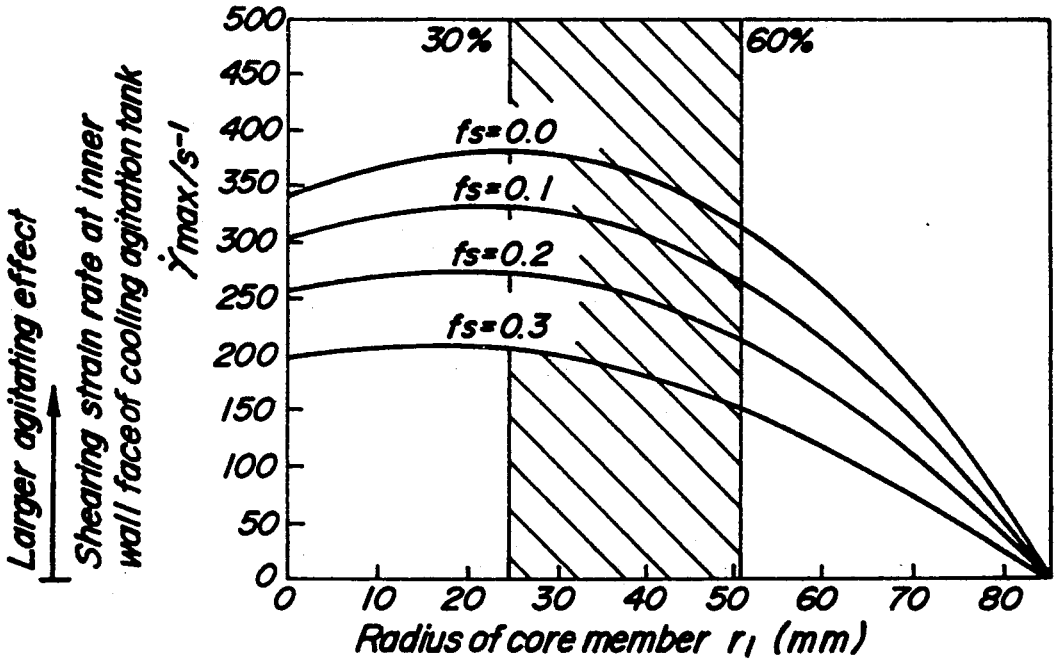
FIGS. 5*a* and 5*b* are graphs showing relations among radii of the core member and shearing rates at inner wall face of the cooling agitation tank and outer wall face of the core member.
Figure 5B:
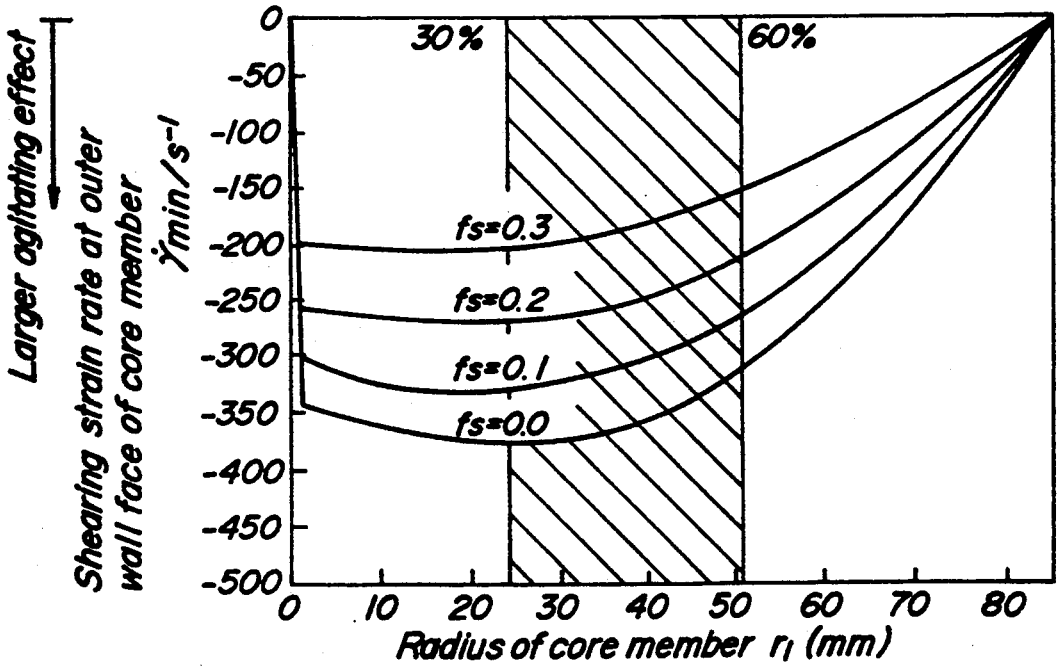
Figure 6:
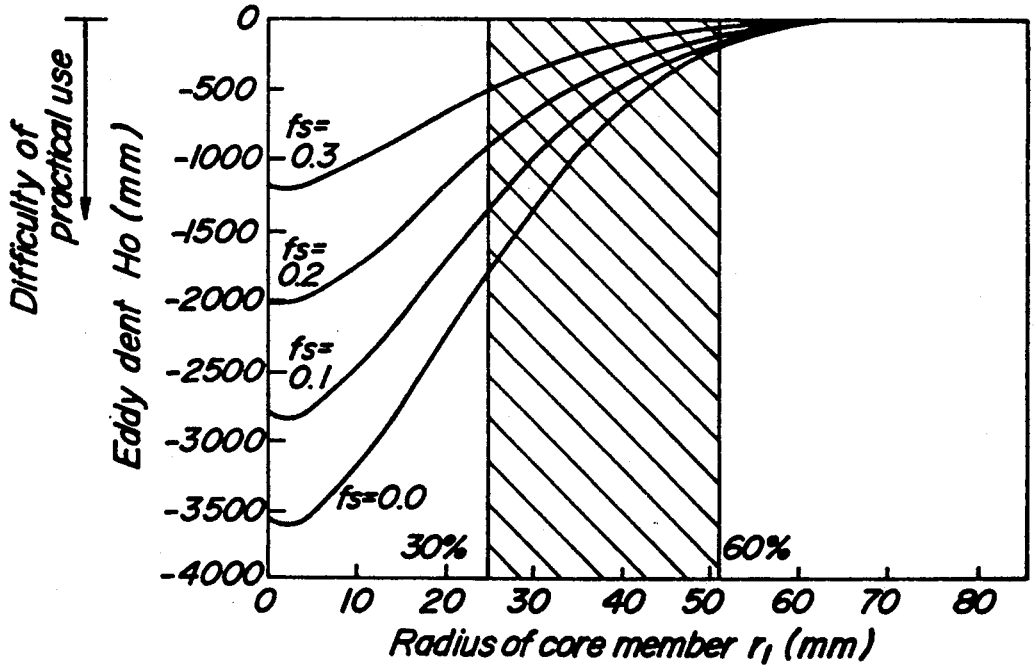
FIG. 6 is a graph showing the relation between radii of the core member and eddy dent of molten metal.

The invention will be described with respect to a relation between inner diameter of the cooling agitation tank (i.e. cooling cylinder 2) and outer diameter of the core member 7 for providing the effective agitating effect. When a rotating magnetic field of 600 gauss is produced inside the cooling agitation tank having an inner diameter of 170 mm and the core member is arranged inside the tank so as to match the center axis of the outer wall face of the core member with the center axis of the inner wall face of the tank, the results measured on the agitating effect are shown in FIGS. 5*a*, 5*b* and 6. In FIGS. 5*a* and 5*b*, relations of the radius ($r_1$) of core member to shearing strain rates at the inner wall face of the tank and outer wall face of the core member are shown using a fraction solid (fs) as a parameter, respectively, and the relation between the radius ($r_1$) of core member and the eddy dent ($H_0$) at outer wall face of the core member is shown in FIG. 6 using a fraction solid (fs) as a parameter. In these graphs, the shadowed portion is a practical region having a large shearing strain rate (agitating effect) and showing a small eddy dent and an optimum radius range of the core member. This region shows that the outer diameter of the core member corresponds to 30–60% of the inner diameter of the cooling agitation tank.

When the semi-solidified metal composition is discharged from the discharge nozzle 6 located at the bottom of the cooling agitation tank 1, there are used a known sliding gate system, rotary valve system, stopper system and the like as a discharge nozzle. Among these systems, however, the sliding gate system and rotary valve system have drawbacks that the flowing of the semi-solidified metal composition through the nozzle is apt to be disturbed and metal is apt to adhere to the nozzle and the restoring is difficult after the adhesion of metal to the nozzle. On the contrary, the stopper system of lifting the stopper in up and down directions to change the opening area of the nozzle is most suitable for controlling the discharge amount of the slurry of semi-solidified metal composition.

According to the preferred embodiment of the invention, the core member is utilized as a stopper. In this case, as shown in FIG. 1, the core member 7 is lifted down so as to contact with the bottom of the cooling agitation tank 1 by the actuation of the hydraulic cylinder 11 above the discharge nozzle 6 at the initial operation stage (shown by a phantom line in FIG. 1), whereby the core member 7 serves as a stopper for clogging the opening of the discharge nozzle 6. Then, molten metal 17 is charged in the cooling agitation tank 1 and cooled and agitated by the cooling cylinder 2 and the electromagnetic induction coil 4 to increase the fraction solid of the resulting slurry as a semi-solidified metal composition. When the fraction solid reaches to a given value, the core member 7 is lifted upward by the actuation of hydraulic cylinder 11 to adjust the opening degree of the stopper and discharge the semi-solidified metal composition from the nozzle 6. That is, the core member 7 is used to serve as a stopper when the molten metal charged in the cooling agitation tank is discharged out from the discharge nozzle 6 at the initial operation stage.

Figure 7:
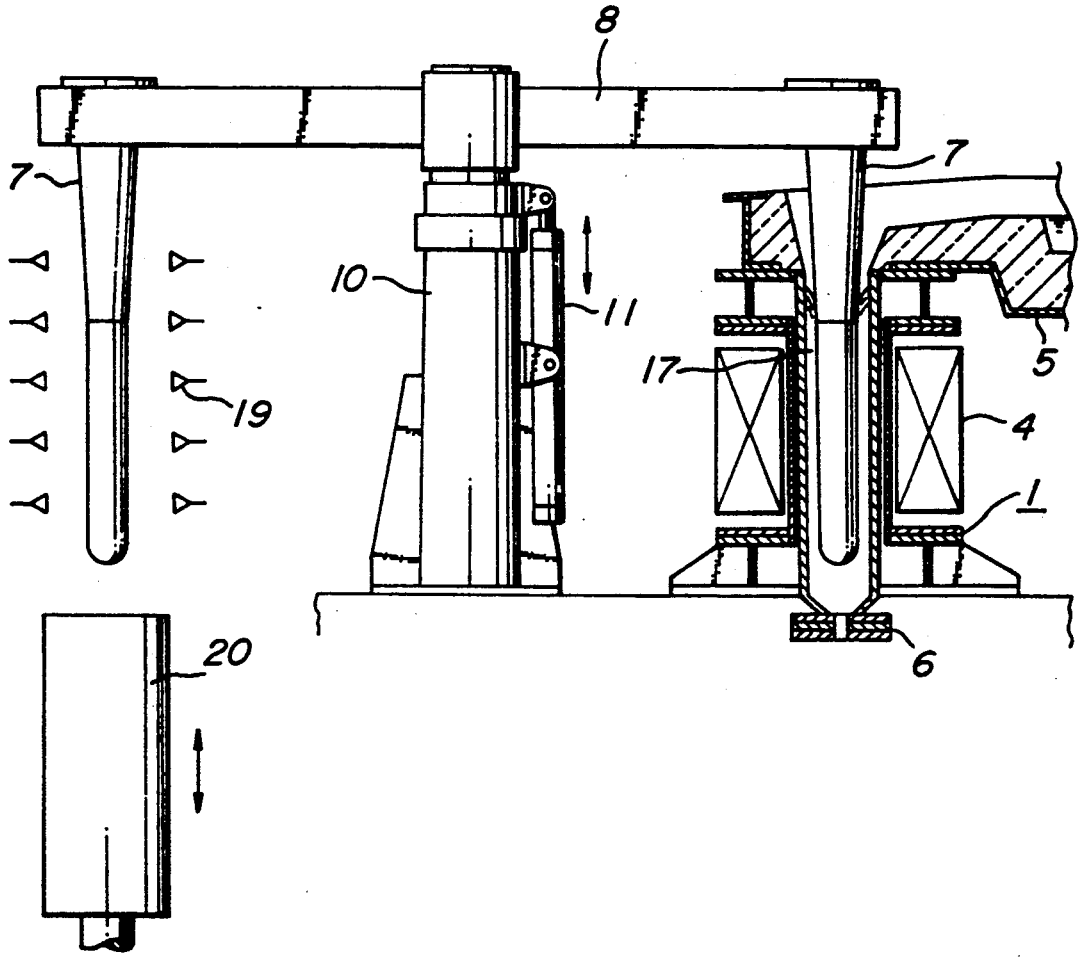
FIG. 7 is an outline of another embodiment of the apparatus for the production of semi-solidified metal composition according to the invention.

In the other preferred embodiment of the invention, as shown in FIG. 7, a cooled body composed of ceramics, cermet, metal or a composite material thereof is used as a core member 7 for enhancing the cooling efficiency against molten metal 17. In this case, at least a pair of the cooled bodies 7 are suspendedly supported by top portions of at least a pair of support arms 8 liftably and turnably moved by the support base 10, respectively. One of the cooled bodies 7 is immersed into molten metal 17 inside the cooling agitation tank 1, while the remaining cooled body 7 is placed at a waiting position, at where the temperature of the cooled body is adjusted to a given initial cooling temperature by means of a temperature adjusting means comprising refrigerant spraying nozzles 19 arranged at both sides of the cooled body and a cylindrical preheating furnace 20 moved in up and down directions so as to surround the cooled body. When these cooled bodies 7 are alternately immersed into molten metal 17, heat can rapidly be removed from molten metal as the temperature difference between the cooled body and molten metal becomes larger, whereby the semi-solidified metal composition in which fine non-dendritic primary solid particles are uniformly dispersed into the remaining liquid matrix can be produced by synergistic action with the agitating effect through electromagnetic induction.

The following examples are given in illustration of the invention and are not intended as limitations thereof.

EXAMPLE 1

This example shows a case that molten metal is cooled and agitated in a cylindrical cooling agitation tank having an inner diameter of 170 mm ($r_2=85$ mm) provided with a bipolar, three-phase agitating coil under a rotating magnetic field showing a center magnetic flux density of 800 gauss.

In the conventional method as shown in FIG. 2, the rotating speed of molten metal was 1000 rpm in the central portion at maximum, and the eddy dent $H_0$ at the rotating central portion was 1200 mm.

In the method of the invention using a cylindrical core member 7 with an outer diameter of 100 mm ($r_1=50$ mm) as shown in FIG. 3, the rotating speed of molten metal was about 200 rpm at a middle point between the outer wall face of the core member 7 and the inner wall face of the cooling agitation tank 1 at maximum and the eddy dent $H_0$ was reduced to 70 mm at a surface of the core member, so that the stable operation was made possible.

When conducting the theoretically estimated calculation for representing the agitating effect as a shearing strain rate, it was 250 $sec^{-1}$ at maximum in the inner wall face of the cooling agitation tank and zero in the rotating central portion according to the conventional method, while it was 230 $sec^{-1}$ at maximum in the inner wall face of the cooling agitation tank and the outer wall face of the core member according to the method of the invention, from which it was apparent that the invention provides an effective agitating effect.

EXAMPLE 2

A cylindrical bottomed vessel having an inner diameter of 170 mm and provided with a water-cooled jacket was set inside an electromagnetic induction coil of 1100 gauss, and then molten cast iron was filled in the vessel and agitated to a solid-liquid coexisting region. In case of using no core member, the cast iron was rotated at 600 rpm and the shape of the surface level was a very deep concave at the center.

When the core member was immersed into the cast iron, the rotating speed was reduced to 300 rpm and the shape of the surface level was a fairly gentle concave.

The cast iron was sampled at the solid-liquid coexisting temperature (fraction solid=25%) and quenchedly solidified, and thereafter the resulting solidified texture was observed. As a result, the texture was uniform because there was no great difference in the shearing strain rate.

Then, a discharge nozzle was arranged in the bottom of the above cylindrical vessel and then 500 kg of molten cast iron was continuously charged thereinto.

When the core member was not used as a stopper, the cast iron was discharged from the discharge nozzle at a substantially liquid state.

On the other hand, when the core member was used as a stopper, the cast iron was filled in the vessel at an initial charging stage while closing the discharge nozzle with the core member and then the discharge of the resulting semi-solidified metal composition was controlled by gradually moving the core member upwardly to balance with the charging rate. As a result, it was confirmed from the measurement of the discharging temperature that the semi-solidified metal composition having a fraction solid of 20% could stably be produced from the initial charging stage to the last charging stage.

For comparison, the control of the discharging amount was made by arranging a sliding gate on the bottom of the discharge nozzle without using the core member as a stopper. When the sliding gate was closed to fill the cast iron in the vessel at the initial charging stage, if the gate was opened, the discharge of the semi-solidified metal composition was impossible because the nozzle was clogged with solidified iron. In order to prevent such a phenomenon, the sliding gate was fully opened at the initial charging stage and gradually closed to control the discharging amount, but a greater part of the cast iron (500 kg) was discharged in a liquid phase state under a nozzle opening condition capable of preventing the clogging of the nozzle, and the discharge of the semi-solidified metal composition was first observed at the last charging stage.

As seen from the above, the use of the core member as a stopper develops the large effect on the stabilization of surface level and the prevention of the gas entrapment and also brings about the stable production of the semi-solidified metal composition.

EXAMPLE 3

Cast iron was cooled and agitated by using an apparatus shown in FIG. 7 to produce a semi-solidified metal composition. In this case, cooling water was passed through the water-cooled jacket 3 at a rate of 600 l/min, and hence the temperature of the cooling water was raised by 1° C. In the case of using the cooled body as a core member 7, therefore, the cooling capacity of the cooling agitation tank 1 was about 600 kcal.min.

When cast iron (C content: 2.5 %) was passed through the cooling agitation tank at a rate of 34 kg.min (5 l/min), if the cooled body was not used as a core member, the cast iron was substantially discharged from the discharge nozzle 6 in a liquid phase state even after about 5 minutes. On the other hand, when the cooled body 7 was immersed into the cast iron inside the cooling agitation tank 1, the semi-solidified metal composition having a fraction solid of 5–10% could stably be produced. In the latter case, the cooled body 7 was made from alumina graphite and had an outer diameter of 100 mm and previously heated to a temperature of 400° C. During the charging of cast iron, the cooled body 7 had a cooling capacity of about 2000–2500 kcal/min, so that the cast iron was cooled by about 4–5 times as compared with the case of conducting only the water cooling. Furthermore, the fraction solid of the semi-solidified metal composition could be changed by changing the outer diameter of the cooled body even at the same charging rate.

In the production of semi-solidified metal compositions through the electromagnetic agitating system according to the invention, there are expected the following merits:

(1) Even when molten metal is agitated through strong turning movement by electromagnetic induction agitation, the eddy dent is small and there is no risk of scattering molten metal from the upper part of the cooling agitation tank, so that the stably practical operation is made possible.

(2) Under the same rotating magnetic field, the agitating effect is the same even when the rotating speed lowers. In the conventional method, the rotating center portion forms a dead space substantially providing no agitating effect, while according to the invention, the uniform agitating effect is substantially obtained over a whole.

(3) An amount of molten metal corresponding to a volume of the core member is eliminated in the cooling agitation tank, so that heat capacity is reduced by a quantity corresponding to such an amount and hence the cooling rate for molten metal is increased even at the same cooling capacity and semi-solidified metal composition having a smaller particle size can be produced.

(4) When the core member is used as a stopper at the initial charging stage, the semi-solidified metal composition can stably be produced by controlling the discharging amount while preventing the gas entrapment.

(5) When the cooled body is used as a core member, the cooling capacity against molten metal can largely be increased by a relatively simple manner. Furthermore, when a plurality of cooled bodies are alternately used, the semi-solidified metal composition can continuously be produced over a long period of time. Moreover, the cooling capacity substantially determined by the structure of the apparatus itself can be changed by changing the size of the cooled body.

As mentioned above, the invention considerably contributes to the practical use of electromagnetic induction agitating system for the production of semi-solidified compositions.

What is claimed is:

1. An apparatus for producing semi-solidified metal compositions through electromagnetic agitation, comprising a cooling agitation tank provided with means for cooling molten metal, an electromagnetic induction coil producing a rotating magnetic field across a section of the tank to rotate molten metal in the tank, and a non-magnetic and non-conductive core member positioned in a central portion of the tank.

2. The apparatus according to claim 1, wherein said core member is rotatably supported by and fixed to a support arm through a torque meter.

3. The apparatus according to claim 1, wherein an outer size of said core member is within a range of 30–60% of an inner diameter of said cooling agitation tank.

4. The apparatus according to claim 1, wherein an inner wall of said cooling agitation tank and an outer surface of said core member are cylindrically shaped.

5. The apparatus according to claim 1, wherein said core member and said cooling agitation tank have center axes and said core member is positioned such that its center axis substantially aligns with the center axis of said cooling agitation tank.

6. The apparatus according to claim 1, wherein when said core member is a stopper and has a hemispherically shaped portion to closely conform with the shape of a discharge port in said cooling agitation tank.

7. The apparatus according to claim 1, wherein when a cooled body is used as said core member, at least two cooled bodies are provided and alternately and repeatedly used in said cooling agitation tank, in which one of the cooled bodies is immersed in molten metal and the remaining cooled body or the used cooled body is cooled or preliminarily heated to a given cooling temperature at a waiting position.

8. The apparatus according to claim 7, wherein said cooled body comprises of ceramic, cermet, metal or a composite body thereof.

9. Apparatus for producing semi-solidified metal compositions by electromagnetic agitation comprising:

a cooling agitation tank provided with means for cooling molten metal;

an electromagnetic induction coil producing a rotating magnetic field across a section of the tank to rotate molten metal in the tank; and a non-magnetic and non-conductive elongated core member positioned in a central portion of the tank and within a central portion of the rotating magnetic field.

10. Apparatus for producing semi-solidified metal compositions by electromagnetic agitation comprising:

a tank provided with means for cooling molten metal;

electromagnetic induction means for producing a rotating magnetic field within at least a portion of the tank to rotate at least a portion of molten metal in the tank; and a non-magnetic and non-conductive core member positioned within the tank and rotating magnetic field.

* * * * *